US011292256B2

(12) United States Patent
Nakajima et al.

(10) Patent No.: US 11,292,256 B2
(45) Date of Patent: Apr. 5, 2022

(54) LIQUID EJECTING HEAD, LIQUID EJECTING APPARATUS, FLOW PATH STRUCTURE, AND METHOD OF MANUFACTURING LIQUID EJECTING HEAD

(71) Applicant: SEIKO EPSON CORPORATION, Tokyo (JP)

(72) Inventors: Yoshinori Nakajima, Matsumoto (JP); Kentaro Murakami, Matsumoto (JP); Yoshiki Sugawara, Shiojiri (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/907,833

(22) Filed: Jun. 22, 2020

(65) Prior Publication Data

US 2020/0398567 A1 Dec. 24, 2020

(30) Foreign Application Priority Data

Jun. 24, 2019 (JP) ..... JP2019-116436

(51) Int. Cl.

| | |
|---|---|
| ***B41J 2/14*** | (2006.01) |
| ***B41J 2/16*** | (2006.01) |
| ***B41J 2/175*** | (2006.01) |

(52) U.S. Cl.

CPC ..... *B41J 2/1433* (2013.01); *B41J 2/162* (2013.01); *B41J 2/1632* (2013.01); *B41J 2/17563* (2013.01); *B41J 2002/14419* (2013.01)

(58) Field of Classification Search

CPC ..... B41J 2002/16594; B41J 2/1433; B41J 2/162; B41J 2/1632; B41J 2/17563; B41J 2/17596

See application file for complete search history.

(56) References Cited

U.S. PATENT DOCUMENTS

| | | | | |
|---|---|---|---|---|
| 5,495,272 | A | 2/1996 | Yamaguchi | |
| 2008/0088652 | A1* | 4/2008 | Miyajima | B41J 2/17513 347/6 |
| 2008/0230141 | A1* | 9/2008 | Hattori | B41J 2/17506 141/18 |
| 2017/0217198 | A1 | 8/2017 | Sato et al. | |
| 2019/0077165 | A1* | 3/2019 | Nakajima | B41J 2/19 |
| 2019/0263134 | A1* | 8/2019 | Hiramoto | B41J 2/19 |

FOREIGN PATENT DOCUMENTS

| | | | |
|---|---|---|---|
| JP | S63-005947 | A | 1/1988 |
| JP | H06-008471 | A | 1/1994 |
| JP | 2001-315341 | A | 11/2001 |
| JP | 2006-130682 | A | 5/2006 |
| JP | 2012-192712 | A | 10/2012 |
| JP | 2017-136823 | A | 8/2017 |

* cited by examiner

*Primary Examiner* — Jason S Uhlenhake

(74) *Attorney, Agent, or Firm* — Workman Nydegger

(57) ABSTRACT

A liquid ejecting head including a nozzle configured to eject a liquid, a liquid flow path communicating with the nozzle, a communication chamber including a communication port configured to communicate with atmospheric air, a partitioning wall portion provided between the liquid flow path and the communication chamber, the partitioning wall portion including an opening portion that communicates the liquid flow path and the communication chamber to each other, and an elastic member closing the opening portion.

20 Claims, 11 Drawing Sheets

LIQUID EJECTING HEAD, LIQUID EJECTING APPARATUS, FLOW PATH STRUCTURE, AND METHOD OF MANUFACTURING LIQUID EJECTING HEAD

The present application is based on, and claims priority from JP Application Serial Number 2019-116436, filed Jun. 24, 2019, the disclosure of which is hereby incorporated by reference herein in its entirety.

BACKGROUND

1. Technical Field

The present disclosure relates to a liquid ejecting head, a liquid ejecting apparatus, a flow path structure, and a method of manufacturing a liquid ejecting head.

2. Related Art

Hitherto, a technique for ejecting a liquid on a medium such as printing paper through nozzles has been proposed. For example, JP-A-63-5947 discloses an ink jet head in which a passage for cleaning (hereinafter, referred to as a "cleaning passage") is formed in a wall surface of an ink passage in communication with nozzles. The cleaning passage extends from the ink passage to an opening formed in an exterior surface of a head body. Insides of the nozzles are cleaned by having the cleaning solution flow through the cleaning passage. When the cleaning is completed, the opening formed in the exterior surface of the head body is closed by a closing member.

In the technique in JP-A-63-5947, at the stage after cleaning, in which the opening of the cleaning passage has been closed by the closing member, air resides in the cleaning passage. Furthermore, due to the flow of the cleaning solution, the dust moved from inside the nozzles may reside in the cleaning passage. In the technique in JP-A-63-5947, the state in which the nozzles are in communication with the cleaning passage is maintained even at the stage when the ink jet head is used. Accordingly, foreign matters such as air bubbles, dust, and the like residing in the cleaning passage moving near the nozzles may cause a liquid ejection failure.

SUMMARY

In order to overcome the above issue, a liquid ejecting head according to an aspect includes a nozzle that ejects a liquid, a liquid flow path in communication with the nozzle, a communication chamber including a communication port configured to communicate with atmospheric air, a partitioning wall portion provided between the liquid flow path and the communication chamber, the partitioning wall portion including an opening portion that communicates the liquid flow path and the communication chamber to each other, and an elastic member that closes the opening portion.

A flow path structure according to an aspect includes a liquid flow path in communication with a nozzle that ejects a liquid, a communication chamber configured to communicate with atmospheric air, a partitioning wall portion provided between the liquid flow path and the communication chamber, the partitioning wall portion including an opening portion that communicates the liquid flow path and the communication chamber to each other, and an elastic member that closes the opening portion.

A method of manufacturing a liquid ejecting head according to an aspect, in which the ejecting head includes a nozzle that ejects a liquid, a liquid flow path in communication with the nozzle, a communication chamber including a communication port configured to communicate with atmospheric air, a partitioning wall portion provided between the liquid flow path and the communication chamber, the partitioning wall portion including an opening portion that communicates the liquid flow path and the communication chamber to each other, and an elastic member accommodated in the communication chamber, the method of manufacturing the liquid ejecting head including cleaning the nozzle and the liquid flow path by supplying a cleaning solution to the communication chamber through the nozzle, the liquid flow path, and the opening portion and by discharging the cleaning solution through the communication port, and press-fitting the elastic member in the opening portion by supplying a gas to the communication chamber through the communication port.

DESCRIPTION OF EXEMPLARY EMBODIMENTS

First Exemplary Embodiment

Figure 1:
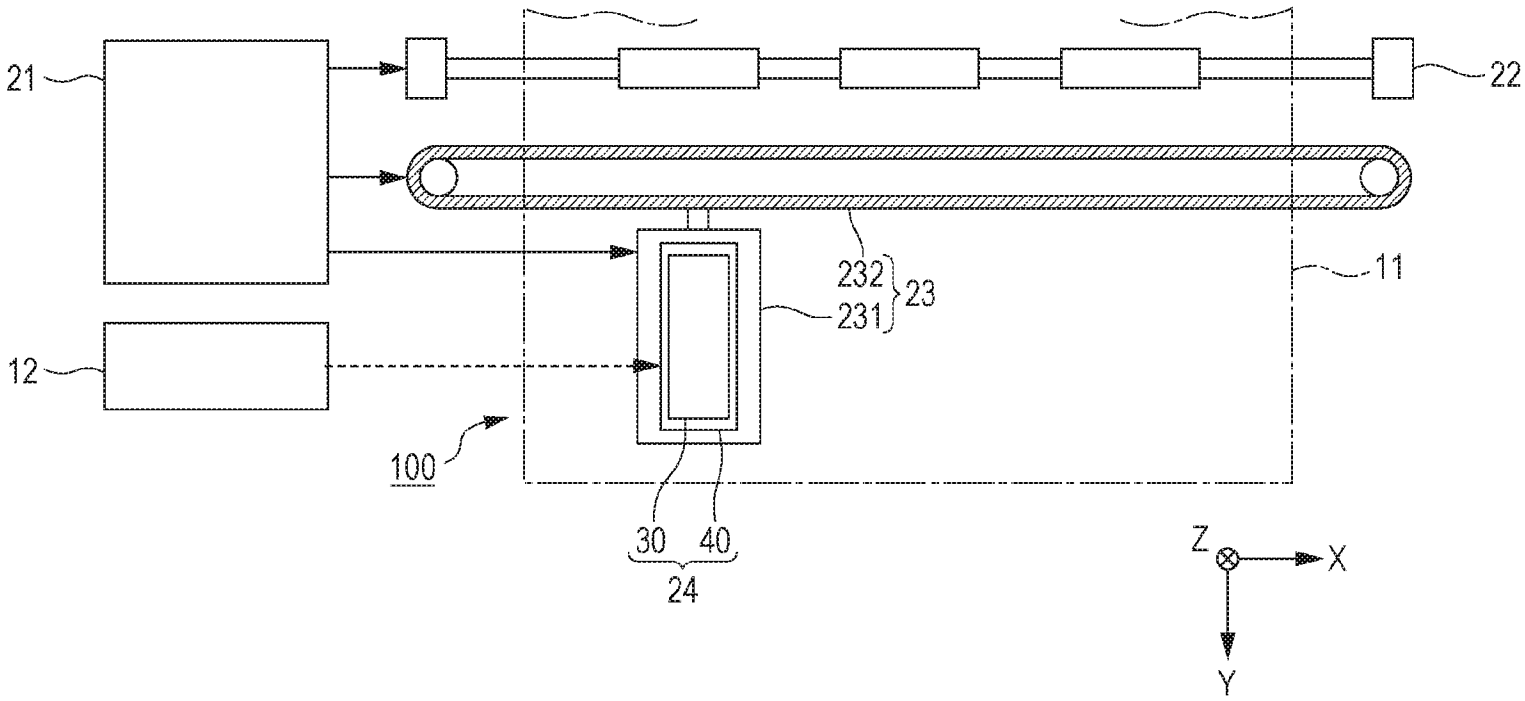
FIG. 1 is a block diagram illustrating a liquid ejecting apparatus according to a first exemplary embodiment.

FIG. 1 is a block diagram of a portion of a liquid ejecting apparatus 100 according to a first exemplary embodiment. The liquid ejecting apparatus 100 of the first exemplary embodiment is an ink jet printing apparatus that ejects droplets of ink, which is an example of a liquid, on a medium 11. The medium 11 is printing paper, for example. However, an object to be printed formed of any material, such as a resin film or fabric, may be used as the medium 11. The liquid ejecting apparatus 100 is provided with a liquid container 12. The liquid container 12 stores the ink. For example, a cartridge configured to detach from the liquid ejecting apparatus 100, a bag-shaped ink pack formed of flexible film, or an ink tank into which ink can be refilled is used as the liquid container 12. Note that any number and any type of ink can be stored in the liquid container 12.

As illustrated as an example in FIG. 1, the liquid ejecting apparatus 100 includes a control unit 21, a transport mechanism 22, a moving mechanism 23, and a liquid ejecting head 24. The control unit 21 including a processing circuit such as a central processing unit (CPU) or a field programmable gate array (FPGA) and a memory circuit such as a semiconductor memory control each element of the liquid ejecting apparatus 100.

The transport mechanism 22 transports the medium 11 along a Y-axis under the control of the control unit 21. The moving mechanism 23 reciprocates the liquid ejecting head 24 along an X-axis under the control of the control unit 21. The X-axis and the Y-axis are orthogonal to each other. The moving mechanism 23 of the first exemplary embodiment includes a substantially box-shaped transport body 231 that houses the liquid ejecting head 24, and an endless belt 232 to which the transport body 231 is fixed. Note that a configuration in which a plurality of liquid ejecting heads 24 are mounted in the transport body 231 or a configuration in which the liquid container 12 is mounted in the transport body 231 together with the liquid ejecting head 24 can be adopted.

The liquid ejecting head 24 ejects ink, which is supplied from the liquid container 12, to the medium 11 through a plurality of nozzles under the control of the control unit 21. Concurrently with the transportation of the medium 11 performed by the transport mechanism 22 and the repetitive reciprocation of the transport body 231, the liquid ejecting head 24 ejects ink onto the medium 11 to form an image on a surface of the medium 11.

The liquid ejecting head 24 includes a flow path structure 30 and a liquid ejecting unit 40. The flow path structure 30 is a structure in which a flow path that supplies the ink, which has been supplied from the liquid container 12, to the liquid ejecting unit 40 is formed. The liquid ejecting unit 40 ejects the ink supplied from the flow path structure 30 through each of the plurality of nozzles.

Figure 2:
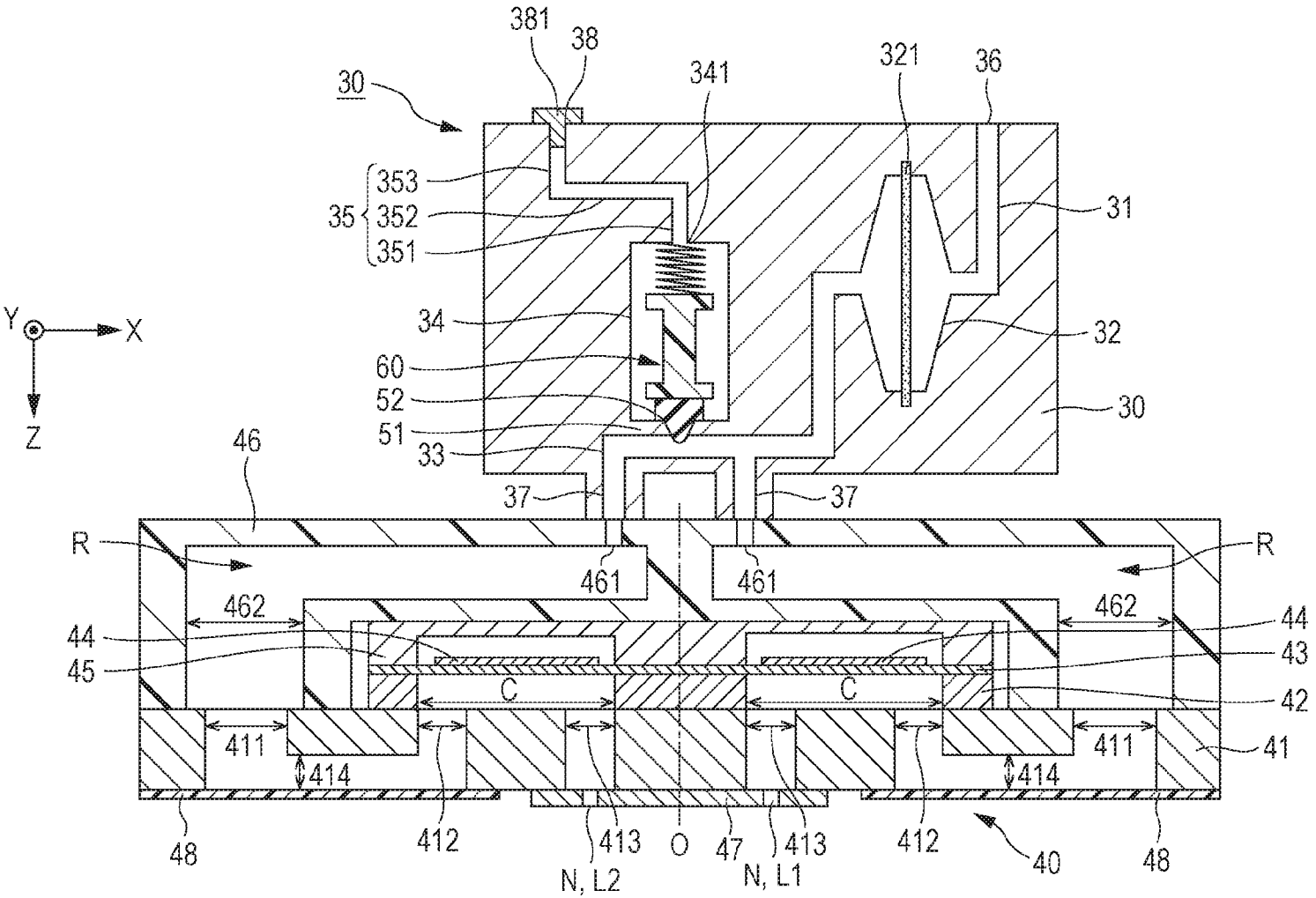
FIG. 2 is a cross-sectional view of a liquid ejecting head.
Figure 3:
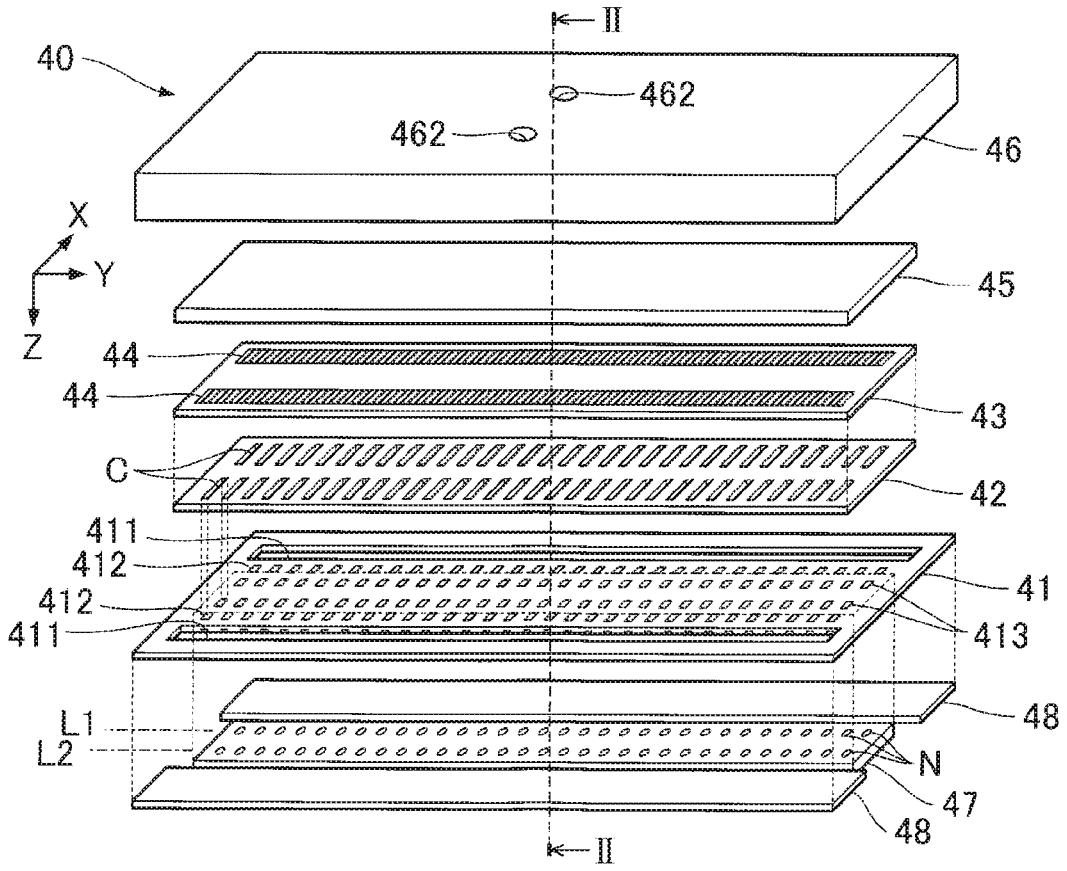
FIG. 3 is an exploded perspective view of a liquid ejecting unit.

FIG. 2 is a cross-sectional view of the liquid ejecting head 24. FIG. 3 is an exploded perspective view of the liquid ejecting unit 40. The cross section of the liquid ejecting unit 40 illustrated in FIG. 2 corresponds to a cross section taken long line II-II in FIG. 3. Note that a Z-axis orthogonal to a XY plane is assumed in the following description. The direction in which the Z-axis extends corresponds to a vertical direction.

As illustrated as an example in FIG. 3, the liquid ejecting unit 40 includes a plurality of nozzles N arranged along the Y-axis. The plurality of nozzles N are divided into a first nozzle line L1 and a second nozzle line L2 that are parallelly arranged with a gap in between. The first nozzle line L1 and the second nozzle line L2 are each a collection of the plurality of nozzles N arranged in a straight line along the Y-axis. As it can be understood from FIG. 2, the liquid ejecting unit 40 of the first exemplary embodiment is structured so that the elements related to each of the nozzles N of the first nozzle line L1 and the elements related to each of the nozzles N of the second nozzle line L2 are provided in substantially plane-symmetric manner with a reference plane O, which is a plane parallel to the YZ plane, in between. Accordingly, in the following description, the elements corresponding to the first nozzle line L1 will be described extensively and a description of the elements corresponding to the second nozzle line L2 will be omitted as appropriate.

As illustrated as an example in FIGS. 2 and 3, the liquid ejecting unit 40 of the first exemplary embodiment includes a first substrate 41, a second substrate 42, a diaphragm 43, a plurality of piezoelectric elements 44, a sealing plate 45, a housing portion 46, a nozzle plate 47, and compliance portions 48. The second substrate 42, the diaphragm 43, the plurality of piezoelectric elements 44, the sealing plate 45, and the housing portion 46 are provided in a Z-axis negative direction with respect to the first substrate 41, and the nozzle plate 47 and the compliance portions 48 are provided in a Z-axis positive direction with respect to the first substrate 41. The nozzle plate 47 is a plate-shaped member in which the plurality of nozzles N constituting the first nozzle line L1 and the second nozzle line L2 are formed.

As illustrated as an example in FIGS. 2 and 3, first spaces 411, a plurality of first supply paths 412, a plurality of second supply paths 413, and relay flow paths 414 are formed in the first substrate 41. Each first space 411 is an opening elongated along the Y-axis. Each first supply path 412 and each second supply path 413 are through holes formed for a corresponding nozzle N. Each relay flow path 414 is a space formed so as to be elongated along the Y-axis and across a plurality of nozzles N. Each relay flow path 414 communicates the corresponding first spaces 411 and the corresponding plurality of first supply paths 412 to each other. Each of the plurality of second supply paths 413 overlaps a single nozzle N corresponding to the relevant second supply path 413 in plan view.

As illustrated as an example in FIGS. 2 and 3, a plurality of pressure chambers C are formed in the second substrate 42. A pressure chamber C is formed for each nozzle N and is a space elongated along the X-axis in plan view. The plurality of pressure chambers C are arranged along the Y-axis.

As illustrated as an example in FIG. 3, the diaphragm 43, which is elastically deformable, is provided on a surface of the second substrate 42 on the side opposite the first substrate 41. When in plan view in the Z-axis direction, the diaphragm 43 is a plate-shaped member formed in a rectcorner shape elongated along the Y-axis. As understood from FIGS. 2 and 3, the pressure chambers C are spaces positioned between the first substrate 41 and the diaphragm 43. As illustrated as an example in FIG. 2, each pressure chamber C is in communication with the corresponding first supply path 412 and the corresponding second supply path 413. Accordingly, each pressure chamber C is in communication with a corresponding one of liquid storage chambers R through the corresponding first supply path 412 and the corresponding relay flow path 414, and is in communication with the corresponding nozzle N through the corresponding second supply path 413.

As illustrated as an example in FIGS. 2 and 3, the piezoelectric elements 44, each for a corresponding pressure chamber C, are formed on a surface of the diaphragm 43 in the Z-axis negative direction. The piezoelectric elements 44 are drive elements each elongated along the X-axis in plan view. A plurality of piezoelectric elements 44 are arranged along the Y-axis. Each piezoelectric element 44 changes the pressure in the corresponding pressure chamber C by being deformed according to a voltage applied thereto. By having the piezoelectric element 44 change the pressure inside the pressure chamber C, the ink inside the pressure chamber C is ejected from the nozzle N. The sealing plate 45 is a structure that protects the plurality of piezoelectric elements 44 and that reinforces the mechanical strength of the second substrate 42 and the diaphragm 43. The sealing plate 43 is fixed to the surface of the diaphragm with an adhesive agent, for example. Note that the pressure chambers C may be formed by selectively removing portions of the second substrate 42 in a thickness direction by etching, for example. In other words, the second substrate 42 and the diaphragm 43 may be formed integrally. Furthermore, instead of the piezoelectric elements 44, heating elements can be employed as the drive elements.

The housing portion 46 in FIG. 3 is a case that stores the ink supplied to the plurality of pressure chambers C and is, for example, formed of a resin material by injection molding. As illustrated as an example in FIG. 2, supply ports 461 and second spaces 462 are formed in the housing portion 46. Each supply port 461 is a pipe line through which the ink is supplied from the flow path structure 30, and is in communication with the corresponding second space 462. As illustrated in FIG. 2, each first space 411 of the first substrate 41 and the corresponding second space 462 of the housing portion 46 are in communication with each other. Spaces configured of the first spaces 411 and the second spaces 462 function as the liquid storage chambers R that store the ink supplied to the plurality of pressure chambers C. The ink supplied from the flow path structure 30 and that has passed through the supply ports 461 is stored in the liquid storage chambers R. The ink stored in the liquid storage chamber R is branched from the relay flow path 414 to the first supply path 412 and is supplied and filled into the plurality of pressure chambers C in a parallel manner. The compliance portions 48 are flexible films constituting wall surfaces of the liquid storage chambers R and absorb the pressure fluctuations of the ink inside the liquid storage chambers R.

As illustrated as an example in FIG. 2, a flow path including a supply flow path 31, a stored liquid chamber 32, a liquid flow path 33, a communication chamber 34, and a communication flow path 35 is formed inside the flow path structure 30. An introduction port 36, discharge ports 37, and a release port 38 are formed in outer wall surfaces of the flow path structure 30. Two discharge ports 37 corresponding to the first nozzle line L1 and the second nozzle line L2 are formed in the flow path structure 30 of the first exemplary embodiment. For example, the flow path structure 30 is configured of layers of a plurality of substrates, and the inner flow path of the flow path structure 30 is formed by the recessed portions formed in the surface of each substrate. Note that a valve mechanism that controls the flow of the ink may be provided inside the flow path structure 30. For example, a control valve that controls the pressure of the ink, or an on-off valve that opens/closes the ink flow path may be provided inside the flow path structure 30.

The supply flow path 31 is a flow path that communicates the introduction port 36 and the stored liquid chamber 32 to each other. The introduction port 36 is an opening through which the ink is supplied from the liquid container 12. A filter 321 that collects foreign matters (air bubbles or dust, for example) mixed in the ink is provided in the stored liquid chamber 32. In other words, numerous fine through holes that allow the ink to pass therethrough but block foreign matters from passing therethrough are formed in the filter 321. Note that the inner diameters of the through holes in the filter 321 in the first exemplary embodiment are set equivalent to or smaller than the inner diameter of the nozzle N.

The liquid flow path 33 is a flow path that communicates the stored liquid chamber 32 and the discharge ports 37 to each other. Each discharge port 37 is an opening that is in communication with the corresponding supply port 461 of the liquid ejecting unit 40. As understood from the above description, the ink supplied to the introduction port 36 from the liquid container 12 passes through the supply flow path 31, the stored liquid chamber 32, the liquid flow path 33, and each discharge port 37, and is supplied to each liquid storage chambers R through the corresponding supply port 461 of the liquid ejecting unit 40. As described above, each liquid storage chamber R is in communication with the corresponding nozzles N. Accordingly, the liquid flow path 33 corresponds to a flow path that is in communication with a plurality of nozzles N. Specifically, the liquid flow path 33 is a flow path that supplies the ink, which has passed through the filter 321 inside the stored liquid chamber 32, to the nozzles N.

The communication chamber 34 is a space in communication with the liquid flow path 33. A cross-sectional shape of the communication chamber 34 in a cross section perpendicular to the Z-axis is circular, for example. The communication flow path 35 is a flow path that communicates the communication chamber 34 and the release port 38 to each other. The release port 38 is an opening in communication with the atmospheric air. In other words, the communication chamber 34 is in communication with the atmospheric air through the communication flow path 35 and the release port 38. In a state in which the liquid ejecting head 24 is in an actually operating state (hereinafter, referred to as an "operating state"), the release port 38 is closed with a closing member 381. Note that the closing member 381 may be omitted.

The communication flow path 35 of the first exemplary embodiment includes a first flow path 351, a second flow path 352, and a third flow path 353. The first flow path 351 communicates the communication chamber 34 and the second flow path 352 to each other. The third flow path 353 communicates the second flow path 352 and the release port 38 to each other. The first flow path 351 and the third flow path 353 both extend along the Z-axis. On the other hand, the second flow path 352 extends in a direction intersecting the Z-axis. For example, the second flow path 352 extends in a direction parallel to the XY plane. As understood from the above description, the communication flow path 35 includes portions that extend along the Z-axis (in other words, the first flow path 351 and the third flow path 353) and a portion that extends in the direction intersecting the Z-axis (in other words, the second flow path 352).

Figure 4:
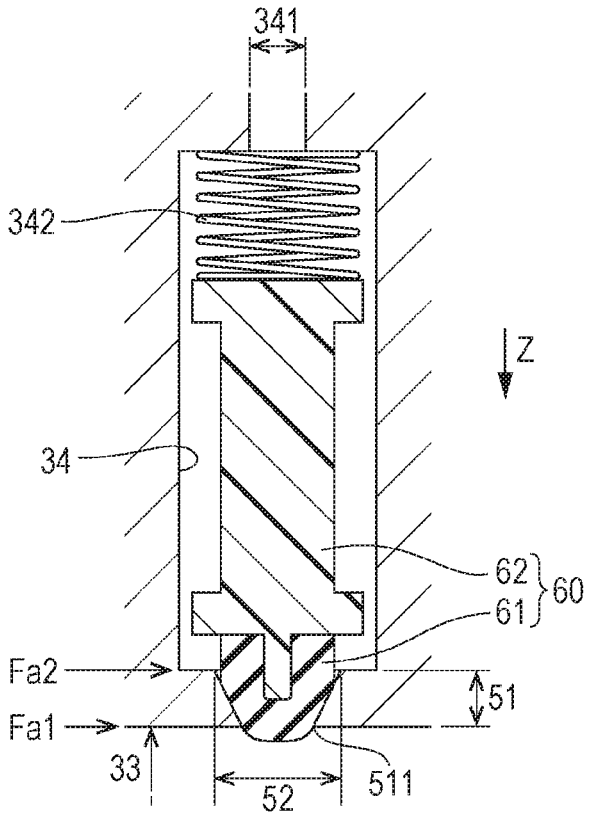
FIG. 4 is a cross-sectional view in which a vicinity of a communication chamber has been enlarged.

FIG. 4 is a cross-sectional view in which a vicinity of the communication chamber 34 has been enlarged. As illustrated as an example in FIG. 4, a communication port 341 is formed in the communication chamber 34. The communication port 341 is an opening formed in an upper surface of the communication chamber 34 and is in communication with the communication flow path 35. In other words, the communication port 341 is an opening that is configured to communicate with the atmospheric air.

As illustrated as an example in FIG. 4, a partitioning wall portion 51 is provided between the liquid flow path 33 and the communication chamber 34. The partitioning wall portion 51 is a wall-shaped portion that partitions the liquid flow path 33 and the communication chamber 34 from each other. As illustrated as an example in FIG. 4, the partitioning wall portion 51 includes a first face Fa1 and a second face Fa2. The first face Fa1 is a flat surface that opposes the liquid flow path 33. The second face Fa2 is a flat surface that opposes the communication chamber 34. In other words, the first face Fa1 is an area that constitutes a portion of an inner wall surface of the liquid flow path 33. In other words, the second face Fa2 is an area that constitutes a portion of an inner wall surface of the communication chamber 34. Specifically, in the communication chamber 34, the second face Fa2 constitutes a bottom surface that opposes an upper surface in which the communication port 341 is formed.

An opening portion 52 that communicates the liquid flow path 33 and the communication chamber 34 to each other is formed in the partitioning wall portion 51. In other words, the partitioning wall portion 51 includes the opening portion 52. In other words, the partitioning wall portion 51 defines the opening portion 52. Specifically, the opening portion 52 is a circular opening that penetrates the partitioning wall portion 51 along the Z-axis from the first face Fa1 to the second face Fa2. In other words, the opening portion 52 is a space branched off from the liquid flow path 33. Specifically, the opening portion 52 branches off from a point between the filter 321 and the nozzle N in the liquid flow path 33. In other words, the Z-axis is a central axis of the opening portion 52. In other words, the central axis of the opening portion 52 extends along the vertical direction.

Figure 5:
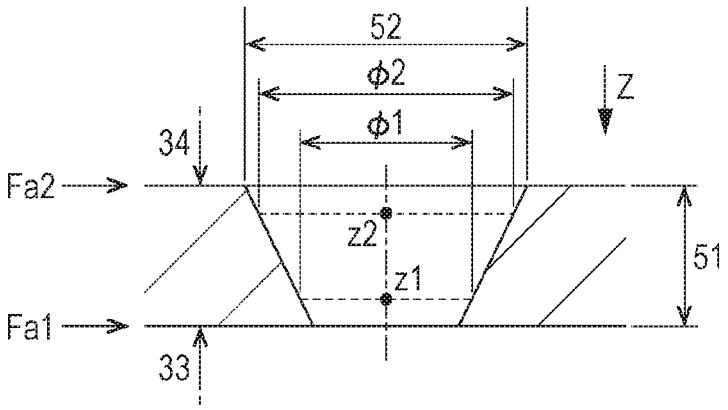
FIG. 5 is a cross-sectional view focused on an opening portion.

FIG. 5 is a cross-sectional view focused on the opening portion 52. FIG. 5 illustrates a first position z1 and a second position z2 on the Z-axis. The first position z1 is any position between the first face Fa1 and the second face Fa2. The second position z2 is any position closer to the communication chamber 34 than the first position z1. In other words, the second position z2 is positioned in the Z-axis negative direction with respect to the first position z1. As illustrated as an example in FIG. 5, an inner circumferential surface of the opening portion 52 is an inclined surface in which an inner diameter $\varphi 1$ at the first position z1 is smaller than an inner diameter $\varphi 2$ at the second position z2 ($\varphi 1 < \varphi 2$). Accordingly, an inner diameter of the opening portion 52 is the smallest in the first face Fa1 and is the largest in the second face Fat. In other words, the opening portion 52 is formed in a tapered shape in which the communication chamber 34 side has a large diameter.

The liquid flow path 33 and each nozzle N are cleaned with a cleaning solution in a process (hereinafter, referred to as a "cleaning process"), which is in a manufacturing process of the liquid ejecting head 24, after the flow path structure 30 and the liquid ejecting unit 40 are assembled. The communication chamber 34, the opening portion 52, and the communication flow path 35 are used in the cleaning process. Specifically, in the cleaning process, the cleaning solution supplied from the outside to the plurality of nozzles N passes through the liquid flow path 33, the opening portion 52, the communication chamber 34, and the communication flow path 35 and is discharged through the release port 38. With the flow of the cleaning solution described above, foreign matters present at the vicinity of the nozzles N are discharged through the release port 38. The opening portion 52 is closed after performing the cleaning process.

As illustrated as an example in FIG. 4, a blocking member 60 is accommodated in the communication chamber 34. The blocking member 60 is a member that closes the opening portion 52 after the cleaning process has been performed. In other words, when the liquid ejecting head 24 is in the operating state, the opening portion 52 is closed by the blocking member 60. The blocking member 60 is biased in a Z-axis positive direction with a biasing member 342 provided between the blocking member 60 and the upper surface of the communication chamber 34. The biasing member 342 is, for example, a spring. When viewed in the Z-axis direction, a cross-sectional area of the blocking member 60 is larger than a cross-sectional area of the communication port 341. Specifically, an external dimension of the blocking member 60 is larger than an inner diameter of the communication port 341. Accordingly, for example, during the cleaning process or when the liquid ejecting head 24 is inclined against the vertical direction, the possibility of the blocking member 60 passing through the communication port 341 and being discharged can be reduced.

The blocking member 60 includes an elastic member 61 and a shaft member 62. The elastic member 61 is an elastic body formed of an elastic material such as rubber, elastomer, or the like. The shaft member 62 is an elongated member formed of a material having a rigidity that is higher than that of the elastic member 61. For example, the elastic member 61 is formed of silicone rubber or butyl rubber having an Asker C hardness of 13 to 30 points, and the shaft member 62 is formed of engineering plastic. The elastic member 61 is provided at an end portion of the shaft member 62. With the above configuration, compared with a configuration in which the elastic member 61 alone is accommodated in the communication chamber 34, the location and the position of the elastic member 61 can be stabilized.

Figure 6:
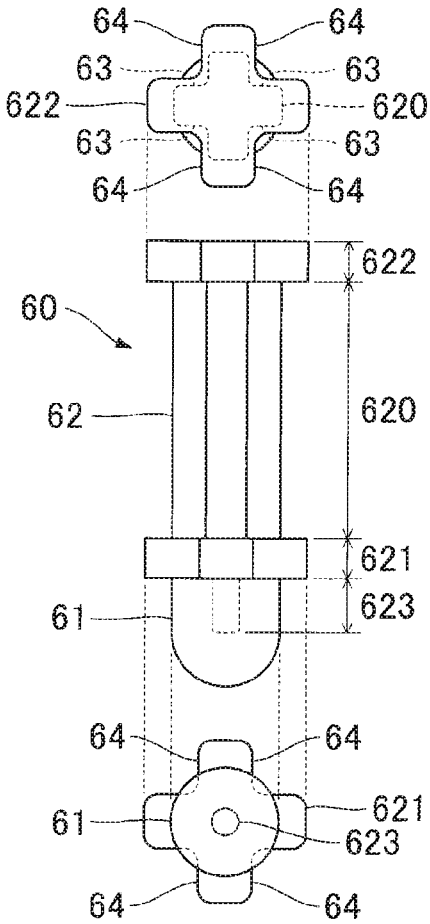
FIG. 6 is a trihedral figure illustrating, as an example, a configuration of a blocking member.
Figure 7:
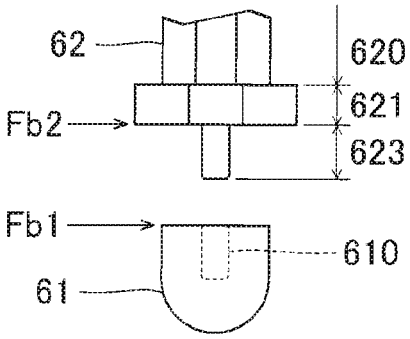
FIG. 7 is a schematic diagram illustrating a state in which the elastic member has been separated from the shaft member.

FIG. 6 is a trihedral figure illustrating, as an example, a configuration of the blocking member 60, and FIG. 7 is a schematic diagram of the elastic member 61 separated from the shaft member 62. The elastic member 61 is a shell-shaped structure in which a front end is formed in a hemispherical curved surface. A planar first mounting face Fb1 is formed on the elastic member 61. A bottomed recessed portion 610 is formed in the first mounting face Fb1.

The shaft member 62 is a component formed integrally by injection molding a resin material, for example, and includes a shaft body 620, a first flange portion 621, a second flange portion 622, and a support end portion 623. The shaft body 620 is a rodlike portion that extends linearly. A plurality of groove portions 63 that extend along the central axis of the shaft body 620 are formed in an outer circumferential surface of the shaft body 620 at intervals in the circumferential direction. Specifically, the cross-sectional shape of the shaft body 620 is substantially cruciform.

The first flange portion 621 is formed in one end portion of the shaft body 620, and the second flange portion 622 is formed in the other end portion of the shaft body 620. In other words, the shaft body 620 is situated between the first flange portion 621 and the second flange portion 622. The first flange portion 621 and the second flange portion 622 are each a flat plate-shaped portion that protrudes in a flange like manner in the radial direction from the outer circumferential surface of the shaft body 620. A plurality of notches 64 are formed at intervals in the circumferential direction in the outer circumferential surface of each of the first flange portion 621 and the second flange portion 622. Specifically, a cross-sectional shape of each of the first flange portion 621 and the second flange portion 622 is substantially cruciform when viewed in the longitudinal direction of the shaft member 62. Even when the blocking member 60 is in contact with the inner wall surface of the communication chamber 34, the cleaning solution can pass through the groove portions 63 and the notches 64. In other words, there is an advantage in that a path of the cleaning solution can be obtained regardless of the position of the blocking member 60.

The support end portion 623 is provided on a side opposite the shaft body 620 with respect to the first flange portion 621. In other words, the first flange portion 621 is situated between the shaft body 620 and the support end portion 623. The support end portion 623 protrudes substantially vertically from a surface (hereinafter referred to as a "second mounting face") Fb2 of the first flange portion 621, which is on a side opposite the shaft body 620. As understood from FIG. 4, the inner diameter of the opening portion 52 is larger than an outer diameter of the support end portion 623. Specifically, the outer diameter of the support end portion 623 is smaller than the inner diameter of the opening portion 52 at the first face Fa1 (in other words, the largest value of the inner diameter). In other words, an opening area of the opening portion 52 is larger than a cross-sectional area of the support end portion 623. Accordingly, the support end portion 623 can be inserted in the opening portion 52.

As illustrated as an example in FIGS. 6 and 7, the elastic member 61 is fixed to the shaft member 62 while in a state in which the support end portion 623 of the shaft member 62 is fitted in the recessed portion 610 of the elastic member 61. In other words, a front end of the support end portion 623 is covered by the elastic member 61. Accordingly, the possibility of the partitioning wall portion 51 being damaged due to the support end portion 623 impacting thereagainst is reduced. As illustrated as an example in FIGS. 6 and 7, the first mounting face Fb1 of the elastic member 61 and the second mounting face Fb2 of the shaft member 62 oppose each other when the elastic member 61 is fixed to the shaft member 62. Note that a height of the support end portion 623 and a depth of the recessed portion 610 are substantially the same. Accordingly, the first mounting face Fb1 and the second mounting face Fb2 are in contact with each other without any gap in between each other. As described above, in the first exemplary embodiment, the elastic member 61 can be provided on the shaft member 62 with a simple configuration in which the support end portion 623 of the shaft member 62 is fitted in the recessed portion 610 of the elastic member 61.

As illustrated as an example in FIG. 6, outer diameters of the first flange portion 621 and the second flange portion 622 are larger than an outer diameter of the elastic member 61. Accordingly, when viewed in an axial direction of the shaft member 62, peripheral portions of the first flange portion 621 and the second flange portion 622 protrude from the outer circumferential edge of the elastic member 61. As understood from the above description, the shaft member 62 of the first exemplary embodiment viewed in the axial direction includes portions positioned outside the outer circumferential edge of the elastic member 61. The above configuration has an advantage in that the location and the position of the blocking member 60 can be maintained in a stable manner by having the portions positioned outside the outer circumferential edge of the elastic member 61 in the shaft member 62 (in other words, the first flange portion 621 and the second flange portion 622) be in contact with the inner wall surface of the communication chamber 34.

As illustrated as an example in FIG. 4, the opening portion 52 is closed by inserting the elastic member 61 in the opening portion 52. Accordingly, when the liquid ejecting head 24 is in the operating state, the ink inside the liquid flow path 33 does not enter the communication chamber 34 through the opening portion 52.

In a state in which the opening portion 52 is closed by the elastic member 61, a portion of the elastic member 61 protrudes to the liquid flow path 33 from the first face Fa1 of the partitioning wall portion 51. Specifically, a portion of the front end of the elastic member 61 protrudes from the first face Fa1 in the Z-axis positive direction. In the above state, the elastic member 61 is caught by an corner portion 511 formed by the first face Fa1 and the inner circumferential surface of the opening portion 52. In other words, the first face Fa1 functions as a holding surface that holds the elastic member 61. As understood from the above description, the first exemplary embodiment has an advantage in that, compared with a configuration in which the elastic member 61 does not protrude from the first face Fa1, the elastic member 61 can be held inside the opening portion 52 in a stable manner.

Furthermore, as illustrated as an example in FIG. 4, in a state in which the opening portion 52 is closed by the elastic member 61, the support end portion 623 is inserted in the opening portion 52. Specifically, the front end of the support end portion 623 is situated between the first face Fa1 and the second face Fat. According to the above configuration, compared with a configuration in which the support end portion 623 is not inserted in the opening portion 52, the possibility of the elastic member 61 detaching from the opening portion 52 is reduced.

Figure 8:
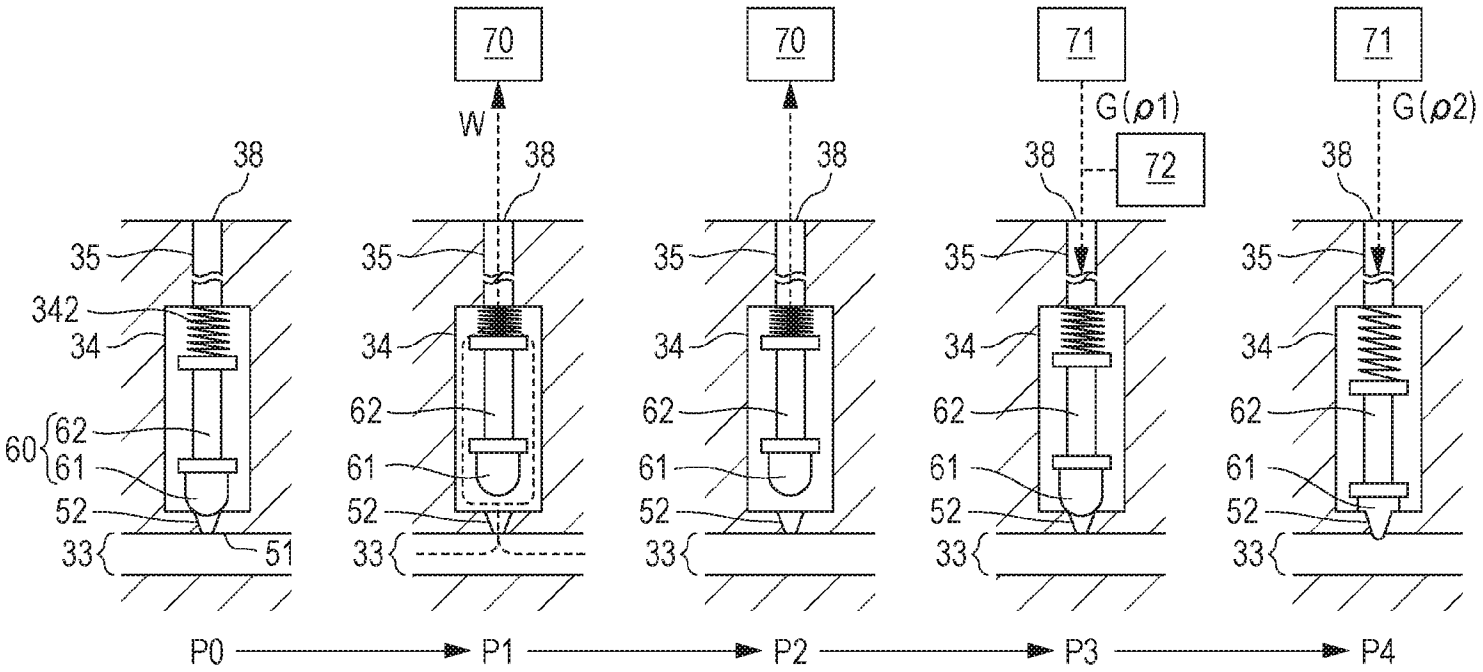
FIG. 8 is an explanatory drawing of a cleaning process of the liquid ejecting head.

FIG. 8 is an explanatory drawing of the cleaning process, which is in the method of manufacturing the liquid ejecting head 24, in which the inner flow path of the liquid ejecting unit 40 is cleaned. As described above, the cleaning process is performed after the flow path structure 30 and the liquid ejecting unit 40 has been assembled. In process P0 in which the cleaning process is started, as illustrated as an example in FIG. 8, the blocking member 60 is urged against the partitioning wall portion 51 with the biasing member 342. Furthermore, in the cleaning process, the introduction port 36 is closed by a sealing member formed of an elastic material such as, for example, rubber or elastomer. Accordingly, while the elastic member 61 is not inserted inside the opening portion 52, the opening portion 52 is closed by the elastic member 61 adhering to an inner circumferential edge of the opening portion 52 in the second face Fat.

In process P1 in FIG. 8, in a state in which the plurality of nozzles N of the liquid ejecting unit 40 is immersed in a cleaning solution W, a suction apparatus 70 coupled to the release port 38 is activated. With the action of the suction apparatus 70, the insides of the communication flow path 35 and the communication chamber 34 are controlled to have a negative pressure. By being suctioned from the release port 38 side, the blocking member 60 moves in the Z-axis negative direction from the position in process P0. In other words, the blocking member 60 is separated from the partitioning wall portion 51. Furthermore, by canceling the closed state of the opening portion 52, the negative pressure inside the communication flow path 35 and the communication chamber 34 acts on the nozzles N through the liquid flow path 33 and the flow paths inside the liquid ejecting unit 40. Accordingly, the cleaning solution W is supplied to the liquid flow path 33 through the plurality of nozzles N and, further, passes through the opening portion 52 and flows into the communication chamber 34. Furthermore, the cleaning solution W passing through the communication flow path 35 is, through the release port 38, ultimately discharged from the communication chamber 34. As understood from the above description, by supplying the cleaning solution W to the communication chamber 34 through the plurality of nozzles N, the liquid flow path 33, and the opening portion 52 and by discharging the cleaning solution W inside the communication chamber 34 through the communication port 341, the plurality of nozzles N and the liquid flow path 33 are cleaned. Note that in process P1, the plurality of nozzles N and the liquid flow path 33 may be cleaned by pressurizing and supplying the cleaning solution W to the plurality of nozzles N of the liquid ejecting unit 40.

In the first exemplary embodiment, the opening portion 52 branched off from the liquid flow path 33 at a point between the nozzles N and the filter 321 is in communication with the communication chamber 34. Accordingly, even when the filter 321 in which the through holes are equivalent to or smaller than the inner diameter of each nozzle N is employed, the cleaning solution W can be supplied to the release port 38 without passing through the filter 321. Accordingly, not only the fine foreign matters in the vicinity of each nozzle N, large foreign matters larger than the diameter of the nozzle N can be removed as well.

After the process P1 has been performed, in process P2, by activating the suction apparatus 70 while the plurality of nozzles N are not immersed in the cleaning solution W, gas such as air or the like is introduced through the plurality of nozzles N. Accordingly, the cleaning solution W is discharged from inside the liquid ejecting head 24. Note that the inner space of the flow path structure 30 is not completely dry. By having moisture of the cleaning solution W appropriately remain between the elastic member 61 and the inner circumferential surface of the opening portion 52, the opening portion 52 is closed without any gap. Accordingly, in process P3 and process P4 described below as an example, the possibility of gas leaking out from the gap between the opening portion 52 and the elastic member 61 is reduced.

After process P2 has been performed, in process P3, gas G having a predetermined pressure ρ1 is supplied to the release port 38 from an air charging system 71. The air charging system 71 is, for example, a pump that sends out air at an optional pressure. The gas G sent out from the air charging system 71 is supplied to the communication chamber 34 through the release port 38 and the communication flow path 35. The pressure ρ1 of the gas G is set to a value smaller than a pressure ρ2 needed to insert the elastic member 61 in the opening portion 52. Accordingly, at the stage of process P3, the elastic member 61 is not inserted in the opening portion 52. In process P3, a measuring apparatus 72 measures the pressure inside the communication chamber 34.

At the stage of process P3, a state in which the elastic member 61 closes the opening portion 52 is expected; however, in actuality, a state in which the position of the blocking member 60 with respect to the opening portion 52 is displaced and in which the opening portion 52 is not closed is assumed. When the opening portion 52 is not closed, the gas G supplied to the communication chamber 34 from the air charging system 71 flows out to the liquid flow path 33 through the opening portion 52. When the gas G from the air charging system 71 is supplied into the liquid ejecting unit 40 from the liquid flow path 33, there is a possibility of the compliance portions 48 being damaged due to the increase in pressure caused by the gas G, or, due to the gas G, there is a possibility of the foreign matters present in the communication chamber 34 or the communication flow path 35 moving to the liquid ejecting unit 40 and entering the nozzles N.

In consideration of the above circumstances, in the first exemplary embodiment, determination is made on whether the opening portion 52 is closed by the elastic member 61. In a state in which the opening portion 52 is not appropriately closed by the elastic member 61, since the gas G in the communication chamber 34 leaks to the liquid flow path 33 through the opening portion 52, the pressure in the communication chamber 34 is below a predetermined threshold value. Accordingly, determination of whether the opening portion 52 is appropriately closed is made based on whether the pressure measured by the measuring apparatus 72 exceeds the threshold value. When the pressure measured by the measuring apparatus 72 is below the threshold value, the position of the blocking member 60 is corrected so that the opening portion 52 is closed by the elastic member 61. As understood from the above description, determination of whether the opening portion 52 is closed is made based on the pressure measured by the measuring apparatus 72.

On the other hand, when in a state in which the opening portion 52 is appropriately closed by the elastic member 61, the pressure in the communication chamber 34 exceeds the threshold value. When the pressure measured by the measuring apparatus 72 exceeds the threshold value, process P4 is started. In process P4, the gas G having the pressure ρ2 that exceeds the pressure ρ1 is supplied to the release port 38 from the air charging system 71. The gas G sent out from the air charging system 71 is supplied to the communication chamber 34 through the release port 38 and the communication flow path 35. The elastic member 61 enters the opening portion 52 while being elastically deformed due to being pressed by the gas G having the pressure ρ2 supplied from the air charging system 71.

Figure 9:
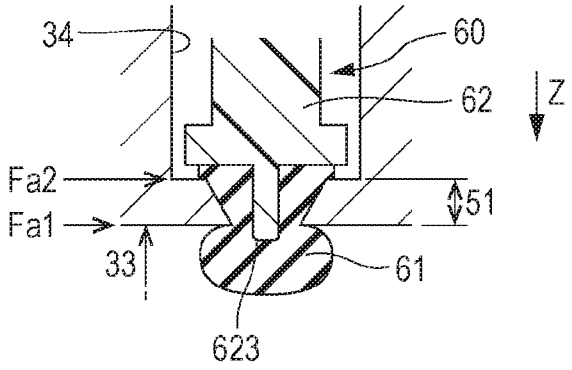
FIG. 9 is a schematic diagram of the elastic member in the cleaning process.

In a state in which the gas G having the pressure ρ2 is supplied to the communication chamber 34, as illustrated in FIG. 9, the front end of the elastic member 61 protrudes into the liquid flow path 33 from the first face Fa1. Furthermore, the support end portion 623 penetrates through the opening portion 52. In other words, the front end of the support end portion 623 protrudes into the liquid flow path 33 from the first face Fa1. In the above state, the supply of the gas G with the air charging system 71 is stopped. When the supply of the gas G is stopped, as illustrated as an example in FIG. 4, the elastic member 61 is maintained in a state inserted in the opening portion 52. As understood from the above description, the elastic member 61 is press-fitted into the opening portion 52 by the gas G supplied from the communication port 341. When the elastic member 61 is press-fitted into the opening portion 52 in process P4, the release port 38 is closed by the closing member 381.

As a configuration that prevents the ink from flowing out through the release port 38 when the liquid ejecting head 24 is in a use state, a configuration (hereinafter, referred to as a "comparative example") in which the elastic member 61 is omitted is assumed as well. In the comparative example, the ink is prevented from flowing out through the release port 38 by closing the release port 38 with the closing member 381. However, in the comparative example, foreign matters remaining in the communication chamber 34 or in the communication flow path 35 in the manufacturing process may move to the liquid flow path 33 and, as a result, the foreign matters may enter the nozzles N. In contrast to the comparative example, in the first exemplary embodiment, the opening portion 52 that communicates the liquid flow path 33 and the communication chamber 34 to each other is closed by the elastic member 61. Accordingly, even if foreign matters were to remain in the communication chamber 34 or the communication flow path 35 in the manufacturing process, when in the operating state in which the opening portion 52 is closed by the elastic member 61, the foreign matters will be prevented from moving to the liquid flow path 33.

In the first exemplary embodiment, the elastic member 61 is press-fitted into the opening portion 52 with the gas G supplied to the communication chamber 34 through the communication port 341. Accordingly, there is an advantage in that, compared with a configuration in which, for example, the elastic member 61 is press-fitted into the opening portion 52 by mechanically pressing the elastic member 61 with a tool, the elastic member 61 can be pressed against the opening portion 52 in a uniform manner. Furthermore, in the first exemplary embodiment, since the communication flow path 35 includes the portions that extend along the Z-axis and the portion that intersects the Z-axis, it is difficult to press the elastic member 61 with a tool inserted through the release port 38. In the first exemplary embodiment, since the elastic member 61 is press-fitted into the opening portion 52 with the gas G, there is an advantage in that the elastic member 61 can be easily inserted in the opening portion 52 even under a circumstance in which the use of the tool is difficult due to the shape of the communication flow path 35.

Note that in a configuration in which the first mounting face Fb1 of the elastic member 61 and the second mounting face Fb2 of the shaft member 62 oppose each other with a gap in between, a pressure may be applied to the first mounting face Fb1 with the gas G supplied from the air charging system 71 and, as a result, the elastic member 61 may become detached from the shaft member 62. In the first exemplary embodiment, since the first mounting face Fb1 and the second mounting face Fb2 are in contact with each other with no gap in between, the first mounting face Fb1 can be prevented from being pressurized with the gas G supplied from the air charging system 71. Accordingly, the possibility of the elastic member 61 being detached from the shaft member 62 can be reduced.

In the first exemplary embodiment, the inner diameter φ1 of the opening portion 52 at the first position z1 is smaller than the inner diameter φ2 of the opening portion 52 at the second position z2. Accordingly, compared with a configuration in which the inner diameter of the opening portion 52 is uniform along the Z-axis, there is an advantage in that the insertion of the elastic member 61 into the opening portion 52 is facilitated. Note that even in a configuration in which, rather than the entire inner circumferential surface of the opening portion 52 being an inclined surface, a portion of the inner circumferential surface is an inclined surface, the insertion of the elastic member 61 into the opening portion 52 is facilitated when compared with a configuration in which the inner diameter of the opening portion 52 is uniform along the Z-axis.

Second Exemplary Embodiment

A description of a second exemplary embodiment will be given. Note that in the following examples, elements having functions similar to those of the first exemplary embodiment will be denoted with the reference numerals used in the description of the first exemplary embodiment, and detailed description of the elements will be omitted appropriately.

Figure 10:
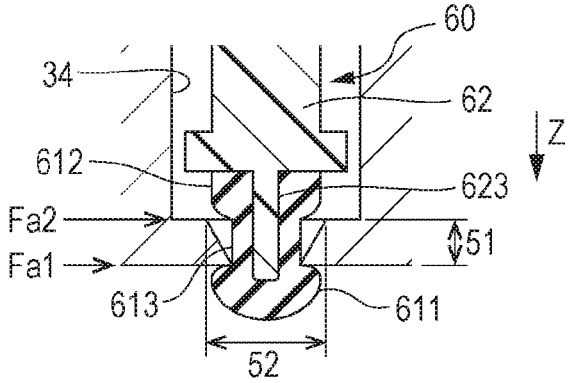
FIG. 10 is an enlarged cross-sectional view of a vicinity of a communication chamber according to a second exemplary embodiment.
Figure 11:
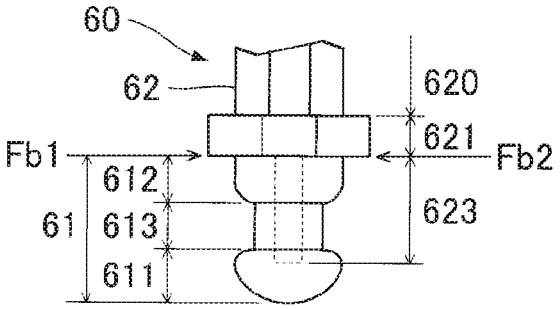
FIG. 11 is a side view of an elastic member according to the second exemplary embodiment.

FIG. 10 is an enlarged cross-sectional view of a vicinity of the communication chamber 34 according to a second exemplary embodiment. FIG. 11 is a side view of the blocking member 60 according to the second exemplary embodiment. In the second exemplary embodiment, the shape of the elastic member 61 is different from that of the first exemplary embodiment. Other configurations are similar to those of the first exemplary embodiment.

As illustrated as an example in FIGS. 10 and 11, the elastic member 61 of the second exemplary embodiment includes, along the central axis of the elastic member 61, a first portion 611, a second portion 612, and a third portion 613. The first portion 611, the second portion 612, and the third portion 613 are integrally formed of rubber or elastomer, for example. The recessed portion 610 extending through the first portion 611, the second portion 612, and the third portion 613 is formed in the first mounting face Fb1.

The first portion 611 is a front end side portion of the elastic member 61. The second portion 612 is a base end side portion of the elastic member 61. In other words, the first mounting face Fb1 is a surface of the second portion 612 opposite the first portion 611. The third portion 613 is a portion situated between the first portion 611 and the second portion 612. In other words, the second portion 612 is situated between the third portion 613 and the first flange portion 621 of the shaft member 62. A cross-sectional area of the third portion 613 is smaller than a cross-sectional area of the first portion 611 and a cross-sectional area of the second portion 612. Specifically, as understood from FIG. 10, an outer diameter of the first portion 611 and an outer diameter of the second portion 612 are larger than an inner diameter of the opening portion 52 at the first face Fa1 (in other words, the minimum value of the inner diameter). On the other hand, an outer diameter of the third portion 613 is equivalent to or smaller than the inner diameter of the opening portion 52 at the first face Fa1.

As illustrated as an example in FIG. 10, in a state in which the elastic member 61 is inserted in the opening portion 52, the first portion 611 is situated in the liquid flow path 33. In other words, the first portion 611 is situated in the Z-axis positive direction with respect to the first face Fa1. The second portion 612 is situated in the communication chamber 34. In other words, the second portion 612 is situated in the Z-axis negative direction with respect to the second face Fat. The third portion 613 is situated inside the opening portion 52.

An effect similar to the first exemplary embodiment can be provided in the second exemplary embodiment as well. Furthermore, in the second exemplary embodiment, since the cross-sectional area of the third portion 613 between the first portion 611 and the second portion 612 is smaller than the cross-sectional areas of the first portion 611 and the second portion 612, the elastic member 61 can be inserted in the opening portion 52 more easily compared with a configuration in which the cross-sectional area of the elastic member 61 is uniform along the central axis. Furthermore, there is an advantage in that the elastic member 61 inserted in the opening portion 52 does not easily become detached.

Third Exemplary Embodiment

Figure 12:
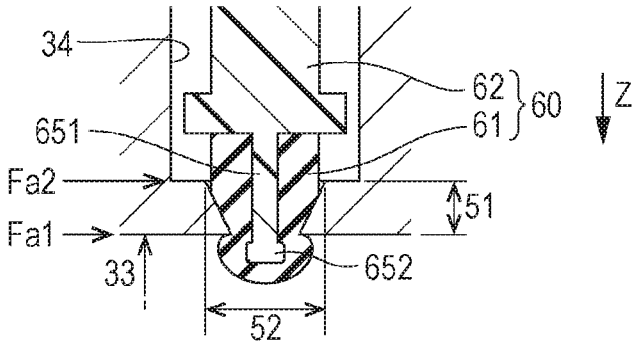
FIG. 12 is an enlarged cross-sectional view of a vicinity of a communication chamber according to a third exemplary embodiment.
Figure 13:
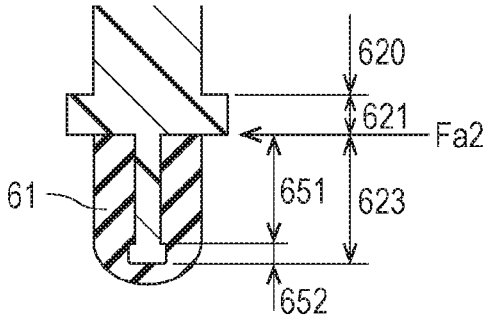
FIG. 13 is a cross-sectional view of an elastic member according to a third exemplary embodiment.

FIG. 12 is an enlarged cross-sectional view of a vicinity of the communication chamber 34 according to a third exemplary embodiment. FIG. 13 is a cross-sectional view of the blocking member 60 according to the third exemplary embodiment. In the third exemplary embodiment, the shape of the support end portion 623 of the shaft member 62 is different from that of the first exemplary embodiment. Other configurations are similar to those of the first exemplary embodiment.

As illustrated as an example in FIGS. 12 and 13, the support end portion 623 of the shaft member 62 according to the third exemplary embodiment includes, along the central axis of the shaft member 62, a first shaft portion 651 and a second shaft portion 652. The second shaft portion 652 is a portion on the front end side of the support end portion 623. In other words, the second shaft portion 652 is situated on the liquid flow path 33 side with respect to the first shaft portion 651. The first shaft portion 651 is situated between the second shaft portion 652 and the first flange portion 621. An outer diameter of the second shaft portion 652 is larger than an outer diameter of the first shaft portion 651. In other words, the second shaft portion 652 has a diameter that is larger than that of the first shaft portion 651. In other words, a cross-sectional area of the second shaft portion 652 is larger than a cross-sectional area of the first shaft portion 651.

As illustrated as an example in FIG. 12, the outer diameter of the second shaft portion 652 is smaller than the inner diameter of the opening portion 52 at the first face Fa1 (in other words, the minimum value of the inner diameter). Accordingly, the first shaft portion 651 and the second shaft portion 652 can pass through the opening portion 52. As illustrated as an example in FIG. 12, in a state in which the elastic member 61 is inserted in the opening portion 52, the second shaft portion 652 is situated in the liquid flow path 33. In other words, the second shaft portion 652 is situated in the Z-axis positive direction with respect to the first face Fa1. On the other hand, the first shaft portion 651 is situated in the Z-axis negative direction with respect to the first face Fa1.

An effect similar to that of the first exemplary embodiment can be provided in the third exemplary embodiment as well. Furthermore, in the third exemplary embodiment, by inserting the second shaft portion 652 that has a diameter that is larger than that of the first shaft portion 651 in the opening portion 52, the possibility of the elastic member 61 detaching from the opening portion 52 can be reduced.

Fourth Exemplary Embodiment

Figure 14:
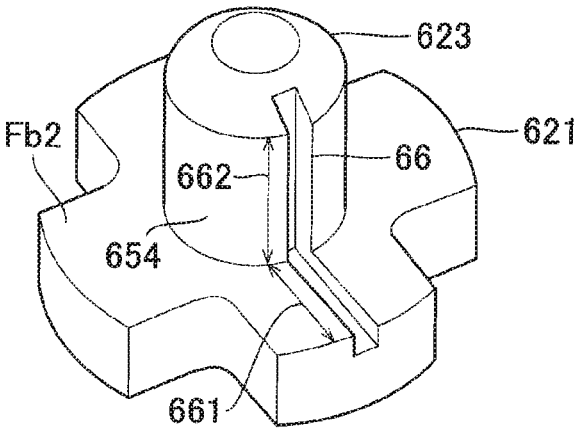
FIG. 14 is a perspective view of a portion of a shaft member according to a fourth exemplary embodiment.

FIG. 14 is a perspective view of the first flange portion 621 and the support end portion 623 of the shaft member 62 according to a fourth exemplary embodiment illustrated in an enlarged manner. As illustrated as an example in FIG. 14, in the shaft member 62 of the fourth exemplary embodiment, a groove portion 66 is formed across the second mounting face Fb2 of the first flange portion 621 and a lateral surface 654 of the support end portion 623. Specifically, the groove portion 66 includes a first groove portion 661 and a second groove portion 662 that are continuous to each other. The first groove portion 661 is a depression in the second mounting face Fb2 and extends in the radial direction from the lateral surface 654 of the support end portion 623 to an outer circumferential edge of the first flange portion 621. The second groove portion 662 is a depression in the lateral surface 654 of the support end portion 623 and extends across the entire length of the support end portion 623 in a direction of the central axis. The first groove portion 661 is closed by the first mounting face Fb1 of the elastic member 61, and the second groove portion 662 is closed by the inner circumferential surface of the recessed portion 610 of the elastic member 61. In other words, a flow path from a portion external to the elastic member 61 to the inner side of the recessed portion 610 is formed.

An effect similar to that of the first exemplary embodiment can be provided in the fourth exemplary embodiment as well. Furthermore, in the fourth exemplary embodiment, the flow path from the outer portion to the inner portion of the elastic member 61 is formed with the groove portion 66. Accordingly, the gas G supplied to the communication chamber 34 from the air charging system 71 in process P4 is supplied to the inner side of the elastic member 61 through the above flow path. In other words, the elastic member 61 is pressed by the gas G from the inner side. Accordingly, the fourth exemplary embodiment has an advantage in that the insertion of the elastic member 61 into the opening portion 52 is facilitated.

Fifth Exemplary Embodiment

Figure 15:
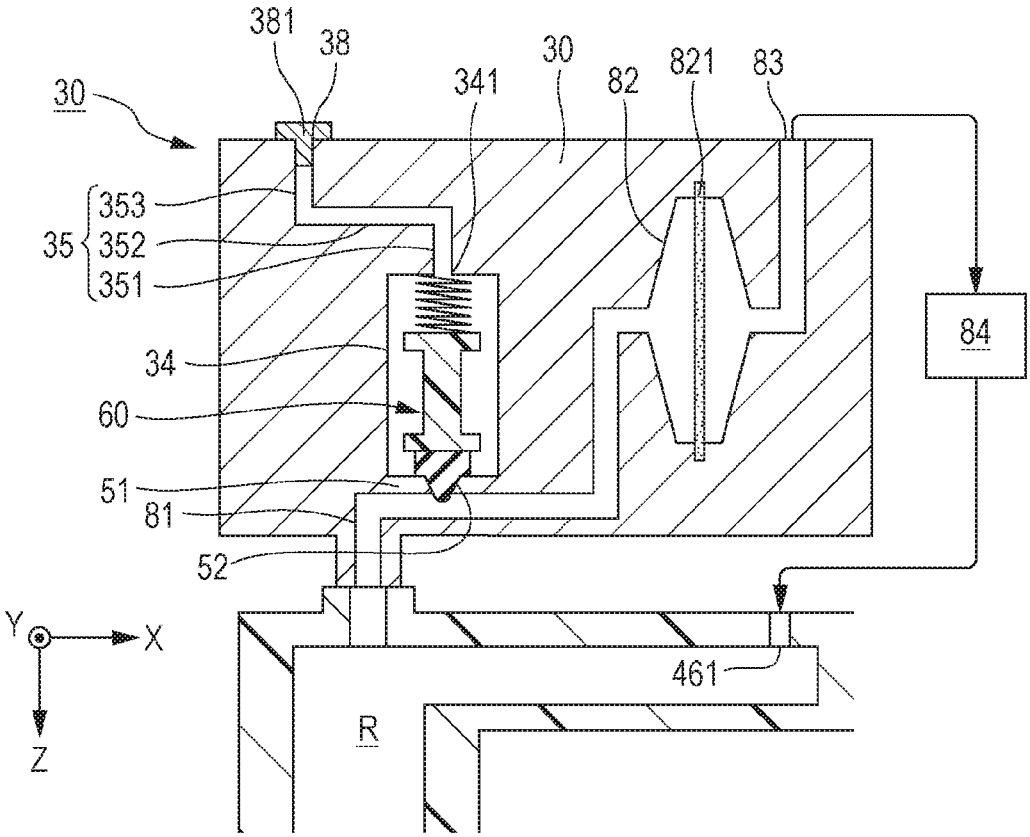
FIG. 15 is a cross-sectional view of a liquid ejecting head according to a fifth exemplary embodiment.

FIG. 15 is a cross-sectional view of a portion of the liquid ejecting head 24 according to a fifth exemplary embodiment. As illustrated as an example in FIG. 15, a circulation flow path 81 that communicates the liquid storage chamber R and the circulation port 83 is formed in the flow path structure 30 of the fifth exemplary embodiment. In the ink that is stored in the liquid storage chamber R, the ink that is not supplied to the nozzles N is discharged to the circulation flow path 81. The ink discharged to the circulation flow path 81 reaches the circulation port 83 through a storage chamber 82 in the circulation flow path 81. A filter 821 that collects foreign matters mixed in the ink is provided in the storage chamber 82. Similar to the filter 321 described above, a plurality of through holes in which the inner diameters are smaller than that of each nozzle N are formed in the filter 821. The ink, from the circulation flow path 81, that has reached the circulation port 83 is circulated to the supply ports 461 of the liquid ejecting unit 40 with a circulation mechanism 84 including, for example, a pump and the like.

As illustrated as an example in FIG. 15, the opening portion 52 is formed so as to branch off from the circulation flow path 81. Specifically, the opening portion 52 branches off from a point between the liquid storage chamber R and the storage chamber 82 in the circulation flow path 81. The opening portion 52 is formed in the partitioning wall portion 51 and communicates the circulation flow path 81 and the communication chamber 34 to each other. The configurations of the communication chamber 34 and the communication flow path 35, and the configuration of the blocking member 60 accommodated in the communication chamber 34 are similar to those of the exemplary embodiments described above.

In the cleaning process in the fifth exemplary embodiment, the cleaning solution W supplied to the plurality of nozzles N from a portion external thereto passes through the liquid storage chamber R, the circulation flow path 81, the opening portion 52, the communication chamber 34, and the communication flow path 35 and is discharged through the release port 38. In other words, the cleaning solution W is supplied to the release port 38 through the opening portion 52, the communication chamber 34, and the communication flow path 35 without passing through the filter 821. An effect similar to that of the first exemplary embodiment can be provided in the fifth exemplary embodiment as well.

Modifications

Each of the exemplary embodiments described above as examples can be modified in various ways. Specific modification modes that can be applied to the configurations described above will be described below as examples. Two or more optionally selected modes from the examples below can be merged as appropriate as long as they do not contradict each other.

Figure 16:
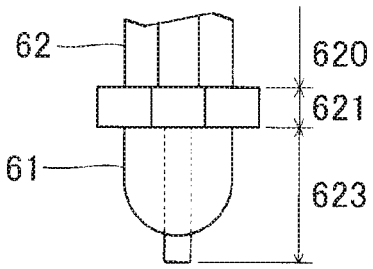
FIG. 16 is a side view of a blocking member according to a modification.

1. In the exemplary embodiments described above, a configuration has been illustrated in which the front end of the support end portion 623 is covered by the elastic member 61. However, as illustrated as an example in FIG. 16, the front end of the support end portion 623 may be protruded from the elastic member 61. In the configuration in FIG. 16, the total length of the support end portion 623 is longer than the total length of the elastic member 61. Furthermore, a through hole is formed in the elastic member 61. Accordingly, the support end portion 623 penetrates through the elastic member 61. In other words, the front end of the support end portion 623 is exposed from the elastic member 61. However, in the configuration in FIG. 16, the front end of the support end portion 623 formed of a hard material may impact the partitioning wall portion 51 in the cleaning process. Accordingly, from the viewpoint of reducing the possibility of the partitioning wall portion 51 becoming damaged by the impact of the support end portion 623, the configuration, as in the exemplary embodiments described above, in which the front end of the support end portion 623 is covered by the elastic member 61 is preferable.

Figure 17:
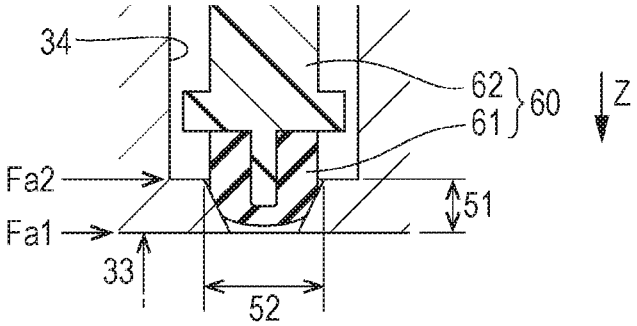
FIG. 17 is an enlarged cross-sectional view of a vicinity of a communication chamber according to a modification.

2. In the exemplary embodiments described above, a configuration in which a portion of the elastic member 61 protrudes in the liquid flow path 33 from the first face Fa1 of the partitioning wall portion 51 has been illustrated as an example However, as illustrated as an example in FIG. 17, a configuration in which the front end of the elastic member 61 is situated in the Z-axis negative direction with respect to the first face Fa1 is employed as well. In other words, the configuration in which a portion of the elastic member 61 protrudes in the liquid flow path 33 is not essential.

Figure 18:
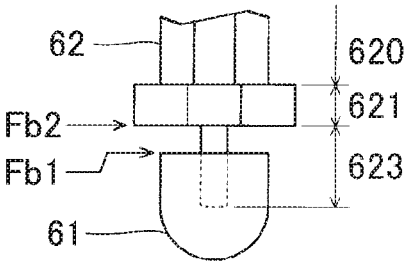
FIG. 18 is a side view of a blocking member according to a modification.

3. In the exemplary embodiments described above, a configuration in which the first mounting face Fb1 of the elastic member 61 and the second mounting face Fb2 of the shaft member 62 adhere to each other has been given as an example; however, as illustrated as an example in FIG. 18, a configuration in which the first mounting face Fb1 and the second mounting face Fb2 oppose each other with a predetermined gap in between is employed as well. In the configuration in FIG. 18, the total length of the support end portion 623 is longer than the depth of the recessed portion 610 of the elastic member 61.

4. In the exemplary embodiments described above, the elastic member 61 and the shaft member 62 formed separately are fixed to each other; however, the method of manufacturing the blocking member 60 is not limited to the example illustrated above. For example, the elastic member 61 and the shaft member 62 may be integrally formed by two color molding. When the blocking member 60 is two color molded, similar to the examples of the exemplary embodiments described above, the first mounting face Fb1 of the elastic member 61 and the second mounting face Fb2 of the shaft member 62 adhere to each other.

Figure 19:
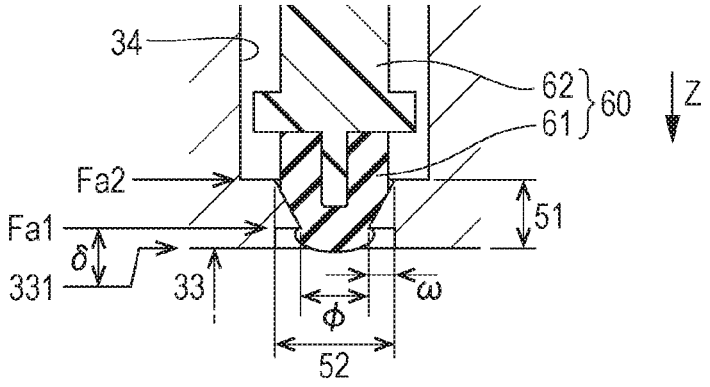
FIG. 19 is an enlarged cross-sectional view of a vicinity of a communication chamber according to a modification.

5. In the exemplary embodiments described above, an example of a configuration in which the first face Fa1 of the partitioning wall portion 51 is continuous to the inner wall surface of the liquid flow path 33 has been described; however, as illustrated in FIG. 19, a step δ may be formed between the first face Fa1 of the partitioning wall portion 51 and an inner wall surface 331 of the liquid flow path 33. The front end portion of the elastic member 61 is accommodated in the space corresponding to the step δ. The first face Fa1 is an annular area formed concentrically with the opening portion 52 when in plan view in the Z-axis direction. A width ω of the first face Fa1 is set equivalent to or larger than 1/50 of an inner diameter φ of the opening portion 52 in the first face Fa1($\omega \geq \varphi/50$). With the above configuration, the front end portion of the elastic member 61 can be accommodated inside the step δ.

6. In the exemplary embodiments described above, the blocking member 60 that includes the elastic member 61 and the shaft member 62 has been described as an example; however, the shaft member 62 may be omitted. However, the configuration of the exemplary embodiments described above in which the elastic member 61 is provided on the hard shaft member 62 has an advantage in that the location and the position of the elastic member 61 become stable.

7. In process P3 or process P4 in FIG. 8, the elastic member 61 may be softened by heating the elastic member 61. For example, in process P3, the elastic member 61 is heated to at least the glass transition temperature. With the above method, since the elastic member 61 is sufficiently inserted in the opening portion 52, the possibility of the elastic member 61 becoming detached from the opening portion 52 when the liquid ejecting head 24 is in the operating state can be reduced.

Figure 20:
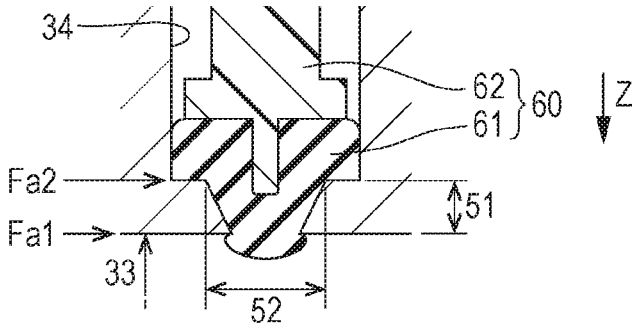
FIG. 20 is an explanatory drawing of a process in which an elastic member according to a modification is inserted into an opening portion.

8. In process P4 in FIG. 8, the elastic member 61 is elastically deformed by having the elastic member 61 pressed against the partitioning wall portion 51 with the gas G supplied to the communication chamber 34. By contracting in the Z-axis direction, the elastic member 61 expands in the radial direction. In the exemplary embodiments described above, an example in which, in process P4, the outer circumferential surface of the elastic member 61 and the inner wall surface of the communication chamber 34 oppose each other with a gap in between has been described. However, as illustrated as an example in FIG. 20, in process P4, the outer circumferential surface of the elastic member 61 may be in contact with the inner wall surface of the communication chamber 34. With the above configuration, since the deformation of the elastic member 61 in the radial direction is restricted, the elastic member 61 can be efficiently advanced in the Z-axis direction. Accordingly, the elastic member 61 is sufficiently inserted in the opening portion 52 and, as a result, the elastic member 61 can be held inside the opening portion 52 in a stable manner.

Figure 21:
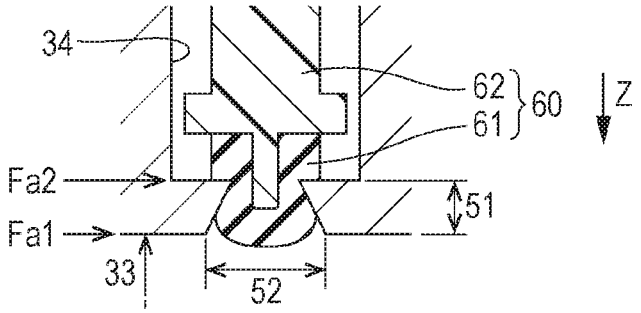
FIG. 21 is an enlarged cross-sectional view of a vicinity of a communication chamber according to a modification.

9. In the exemplary embodiments described above, an example of a tapered opening portion 52 in which the diameter is large in the Z-axis negative direction has been described; however, the shape of the opening portion 52 is not limited to the example described above. For example, as illustrated as an example in FIG. 21, a tapered opening portion 52 in which the diameter is large in the Z-axis positive direction may be formed in the partitioning wall portion 51. Alternatively, a straight tubular opening portion 52 in which the inner diameter is uniform across the entire length in the Z-axis direction may be formed.

10. In the exemplary embodiments described above, while a serial liquid ejecting apparatus 100 that reciprocates the liquid ejecting head 24 along the X-axis has been described as an example, a line liquid ejecting apparatus in which a plurality of nozzles N are distributed across the entire width of the medium 11 is applied to the present disclosure as well.

11. The liquid ejecting apparatus 100 described as an example in the embodiments described above may be employed in various apparatuses other than an apparatus dedicated to printing, such as a facsimile machine and a copier. Note that the application of the liquid ejecting apparatus is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

Additional Statement

For example, the following configurations are comprehended from the configurations described above as examples.

A liquid ejecting head according to a suitable aspect (first aspect) includes a nozzle that ejects a liquid, a liquid flow path in communication with the nozzle, a communication chamber including a communication port configured to communicate with atmospheric air, a partitioning wall portion provided between the liquid flow path and the communication chamber, the partitioning wall portion including an opening portion that communicates the liquid flow path and the communication chamber to each other, and an elastic member that closes the opening portion. In the above aspect, the opening portion that communicates the liquid flow path and the communication chamber to each other is closed by the elastic member; accordingly, compared with a configuration in which the communication port of the communication chamber is closed by the elastic member, foreign matters can be suppressed from entering the nozzle from the communication chamber. Note that "the communication port configured to communicate with atmospheric air" includes a state in which the communication port actually communicates with the atmospheric air, and a state in which the communication port or a flow path in communication with the communication port is closed by a closing member.

In a specific example (a second aspect) of the first aspect, the partitioning wall portion includes a first face that opposes the liquid flow path, and a second face that opposes the communication chamber, and a portion of the elastic member protrudes from the first face to a liquid flow path side. In the above aspect, the elastic member protrudes from the first face to the liquid flow path side. Accordingly, compared with a configuration in which the elastic member does not protrude from the first face to the liquid flow path side, the elastic member can be held inside the opening portion in a stable manner. The "first face that opposes the liquid flow path" is, in other words, a surface that constitutes an inner wall surface of the liquid flow path. Similarly, the "second face that opposes the communication chamber" is, in other words, a surface that constitutes an inner wall surface of the communication chamber.

In a specific example (a third aspect) of the first or second aspect, the elastic member is press-fitted into the opening portion with a gas supplied through the communication port. According to the above aspect, it will be possible to press-fit the elastic member in the opening portion with the gas supplied to the communication chamber through the communication port. According to the method of press-fitting the elastic member in the opening portion by applying pressure to the elastic member with the gas, compared with a configuration in which, for example, the elastic member is mechanically pressed with a tool, there is an advantage in that the elastic member can be pressed against the opening portion in a uniform manner.

In a specific example (a fourth aspect) of any of the first to third aspects, the elastic member includes, along a central axis of the elastic member, a first portion situated on a liquid flow path side, a second portion situated on a communication chamber side, and a third portion situated between the first portion and the second portion, a cross-sectional area of the third portion is smaller than cross-sectional areas of the first portion and the second portion. In the above aspect, since the cross-sectional area of the third portion is smaller than the cross-sectional areas of the first portion and the second portion, compared with a configuration in which the cross-sectional area of the elastic member is uniform, insertion of the elastic member in the opening portion is facilitated. Furthermore, there is an advantage in that the elastic member inserted in the opening portion does not easily become detached.

In a specific example (a fifth aspect) of any of the first to fourth aspects, an inner circumferential surface of the opening portion includes an inclined surface in which an inner diameter at a first position in a direction of a central axis of the opening portion is smaller than an inner diameter at a second position that is closer to the communication chamber than the first position. In the above aspect, the inner diameter of the opening portion at the first position is smaller than the inner diameter of the opening portion at the second position that is closer to the communication chamber than the first position. Accordingly, compared with a configuration in which the inner diameter of the opening portion is uniform along the central axis, insertion of the elastic member in the opening portion is facilitated.

The liquid ejecting head according to a specific example (a sixth aspect) of any of the first to fifth aspects further includes a shaft member that has a rigidity that is higher than that of the elastic member, in which the elastic member is provided on the shaft member. According to the above aspect, since the elastic member is provided on a shaft member that has a rigidity that is higher than that of the elastic member, the location and the position of the elastic member can be stabilized.

In a specific example (a seventh aspect) of the sixth aspect, the shaft member includes a support end portion situated on a liquid flow path side, and the elastic member includes a recessed portion that fits the support end portion thereto. In the above aspect, the elastic member can be provided on the shaft member with a simple configuration in which the recessed portion of the elastic member is fitted to the support end portion of the shaft member.

In a specific example (an eighth aspect) of the seventh aspect, an inner diameter of the opening portion is larger than an outer diameter of the support end portion. In the above aspect, since the inner diameter of the opening portion is larger than the outer diameter of the support end portion, the support end portion can be inserted in the opening portion. Accordingly, the elastic member can be reliably inserted in the opening portion.

In a specific example (a ninth aspect) of the seventh or eighth aspect, the support end portion is inserted in the opening portion. In the above aspect, since the support end portion is inserted in the opening portion, a possibility of the elastic member detaching from the opening portion can be reduced.

In a specific example (a tenth aspect) according to any one of the seventh to ninth aspects, a front end of the support end portion is covered by the elastic member. In the above aspect, since the front end of the support end portion is covered by the elastic member, for example, the possibility of the partitioning wall portion becoming damaged by the impact of the support end portion can be reduced.

In a specific example (an eleventh aspect) according to any one of the seventh to tenth aspects, the support end portion includes, along a central axis of the shaft member, a first shaft portion and a second shaft portion, the second shaft portion is positioned on the liquid flow path side with respect to the first shaft portion, and an outer diameter of the second shaft portion is larger than an outer diameter of the first shaft portion. With the above configuration, the possibility of the elastic member becoming detached from the opening portion can be reduced by inserting the second shaft portion in the opening portion.

In a specific example (a twelfth aspect) according to any one of the seventh to eleventh aspects, the elastic member includes a first mounting face in which the recessed portion is formed, the shaft member includes a second mounting face in which the support end portion protrudes, and the first mounting face and the second mounting face are in contact with each other. In the above aspect, the first mounting face of the elastic member and the second mounting face of the shaft member come in contact with each other. In other words, the first mounting face and the second mounting face are fixed to each other while opposing each other with no gap in between. Accordingly, compared with a configuration in which the first mounting face and the second mounting face oppose each other with a gap in between, the possibility of the elastic member becoming detached from the shaft member is reduced.

In a specific example (a thirteenth aspect) of the twelfth aspect, the shaft member includes a groove portion across the second mounting face and a lateral surface of the support end portion. In the above aspect, the elastic member is pressed from the inside with the gas supplied through the groove portion across the second mounting face and the lateral surface of the support end portion. Accordingly, there is an advantage in that insertion of the elastic member in the opening portion is facilitated.

In a specific example (a fourteenth aspect) according to any one of the sixth to thirteenth aspects, the shaft member includes a portion that is positioned outside an outer circumferential edge of the elastic member when viewed in an axial direction of the shaft member. In the above aspect, the location and the position of the elastic member can be maintained in a stable manner by having the portion in the shaft member that is positioned outside the outer circumferential edge of the elastic member contact the inner wall surface of the communication chamber.

In a specific example (a fifteenth aspect) according to any one of the first to fourteenth aspects, the communication port is configured to communicate with atmospheric air through a communication flow path, and the communication flow path includes a portion that extends along a central axis of the opening portion, and a portion that extends in a direction intersecting the central axis. As in the above aspect, in a configuration in which the communication flow path that communicates the communication chamber with the atmospheric air includes the portion that extends in the direction intersecting the central axis of the opening portion, it is difficult to insert the elastic member in the opening portion with, for example, a tool. Accordingly, the configuration in which the elastic member can be press-fitted in the opening portion with the gas supplied to the communication chamber through the communication flow path is especially effective in the present aspect.

The liquid ejecting head according to a specific example (a sixteenth aspect) of any of the first to fifteen aspects further includes a filter that collects foreign matter mixed in the liquid, in which the liquid flow path is a flow path that supplies the liquid, which passed the filter, to the nozzle, and the opening portion is a space branched off from a point in the liquid flow path between the filter and the nozzle. In the above aspect, by having the cleaning solution flow from the nozzle to the communication chamber through the opening portion, the foreign matter in the vicinity of the nozzle can be discharged to an external portion without passing through the filter.

In a specific example (a seventeenth aspect) according to any one of the first to sixteenth aspects, a cross-sectional area of the elastic member is larger than a cross-sectional area of the communication port when viewed in a direction of a central axis of the opening portion. In the above aspect, since the cross-sectional area of the elastic member is larger than the cross-sectional area of the communication port, the possibility of the elastic member passing through the communication port and being discharged to an outside portion is reduced.

In a specific example (an eighteenth aspect) according to any one of the first to seventeenth aspects, the elastic member is rubber or elastomer. In a specific example (a nineteenth aspect) according to any one of the first to eighteenth aspects, a central axis of the opening portion extends in a vertical direction. In the above aspect, since the direction in which elastic member is pushed in is the gravitational direction, the position of the elastic member before insertion into the opening portion can be easily stabilized.

A liquid ejecting apparatus according to a suitable aspect (a twentieth aspect) includes a liquid ejecting head according to any one of the above aspects, and a transport mechanism that transports the medium on which a liquid is ejected by the liquid ejecting head.

A flow path structure according to a suitable aspect (a twenty-first aspect) includes a liquid flow path in communication with a nozzle that ejects a liquid, a communication chamber configured to communicate with atmospheric air, a partitioning wall portion provided between the liquid flow path and the communication chamber, the partitioning wall portion including an opening portion that communicates the liquid flow path and the communication chamber to each other, and an elastic member that closes the opening portion.

A method of manufacturing a liquid ejecting head according to a suitable aspect (a twenty-second aspect) including a nozzle that ejects a liquid, a liquid flow path in communication with the nozzle, a communication chamber including a communication port configured to communicate with atmospheric air, a partitioning wall portion provided between the liquid flow path and the communication chamber, the partitioning wall portion including an opening portion that communicates the liquid flow path and the communication chamber to each other, and an elastic member accommodated in the communication chamber, the method of manufacturing the liquid ejecting head including cleaning the nozzle and the liquid flow path by supplying a cleaning solution to the communication chamber through the nozzle, the liquid flow path, and the opening portion and by discharging the cleaning solution through the communication port, and press-fitting the elastic member in the opening portion by supplying a gas to the communication chamber through the communication port.

What is claimed is:

1. A liquid ejecting head comprising:

a nozzle configured to eject a liquid;

a liquid flow path communicating with the nozzle;

a communication chamber including a communication port configured to communicate with atmospheric air;

a partitioning wall portion provided between the liquid flow path and the communication chamber, the partitioning wall portion including an opening portion; and an elastic member configured to close the opening portion, wherein the partitioning wall portion includes a first face and a second face being opposite from the first face, the first face defining a portion of the liquid flow path and a second face defining a portion of the communication chamber, and the liquid flow path and the communication chamber communicate with each other via the opening portion in a state that the elastic member opens the opening portion.

2. The liquid ejecting head according to claim 1, wherein a portion of the elastic member protrudes from the first face towards the liquid flow path.

3. The liquid ejecting head according to claim 1, wherein the elastic member is press-fitted into the opening portion with a gas supplied through the communication port.

4. The liquid ejecting head according to claim 1, wherein the elastic member includes, along a central axis of the elastic member, a first portion situated on a liquid flow path side, a second portion situated on a communication chamber side, and a third portion situated between the first portion and the second portion, and a cross-sectional area of the third portion is smaller than a cross-sectional area of the first portion and a cross-sectional area of the second portion.

5. The liquid ejecting head according to claim 1, wherein an inner circumferential surface of the opening portion includes an inclined surface such that an inner diameter at a first position with respect to a direction of a central axis of the opening portion is smaller than an inner diameter at a second position with respect to the direction of the central axis of the opening portion, the second position being closer to the communication chamber than is the first position.

6. The liquid ejecting head according to claim 1, further comprising:

a shaft member having a rigidity that is higher than that of the elastic member, wherein the elastic member is provided on the shaft member.

7. The liquid ejecting head according to claim 6, wherein the shaft member includes a support end portion situated on a liquid flow path side, and the elastic member includes a recessed portion that fits the support end portion thereto.

8. The liquid ejecting head according to claim 7, wherein an inner diameter of the opening portion is larger than an outer diameter of the support end portion.

9. The liquid ejecting head according to claim 7, wherein the support end portion is inserted in the opening portion.

10. The liquid ejecting head according to claim 7, wherein a front end of the support end portion is covered by the elastic member.

11. The liquid ejecting head according to claim 7, wherein the support end portion includes, along a central axis of the shaft member, a first shaft portion and a second shaft portion, the second shaft portion is closer to the liquid flow path than is the first shaft portion, and an outer diameter of the second shaft portion is larger than an outer diameter of the first shaft portion.

12. The liquid ejecting head according to claim 7, wherein the elastic member includes a first mounting face in which the recessed portion is formed, the shaft member includes a second mounting face in which the support end portion protrudes, and the first mounting face and the second mounting face are in contact with each other.

13. The liquid ejecting head according to claim 12, wherein the shaft member includes a groove portion across a lateral surface of the support end portion and the second mounting face.

14. The liquid ejecting head according to claim 6, wherein the shaft member includes a portion that is positioned outside an outer circumferential edge of the elastic member when viewed in an axial direction of the shaft member.

15. The liquid ejecting head according to claim 1, wherein the communication port is configured to communicate with atmospheric air through a communication flow path, and the communication flow path includes a portion that extends along a central axis of the opening portion, and a portion that extends in a direction intersecting the central axis.

16. The liquid ejecting head according to claim 1, further comprising:

a filter configured to collect foreign matter mixed in the liquid, wherein the liquid flow path is a flow path that supplies the liquid, which passed the filter, to the nozzle, and the opening portion is a space branched off from a point in the liquid flow path between the filter and the nozzle.

17. The liquid ejecting head according to claim 1, wherein a cross-sectional area of the elastic member is larger than a cross-sectional area of the communication port when viewed in a direction of a central axis of the opening portion.

18. A liquid ejecting apparatus comprising:

a liquid ejecting head according to claim 1, the liquid ejecting head ejecting a liquid on a medium; and a transport mechanism that transports the medium.

19. A flow path structure comprising:

a liquid flow path communicating with a nozzle configured to eject a liquid;

a communication chamber configured to communicate with atmospheric air;

a partitioning wall portion provided between the liquid flow path and the communication chamber, the partitioning wall portion including an opening portion; and an elastic member configured to close the opening portion, wherein the partitioning wall portion includes a first face and a second face being opposite from the first face, the first face defining a portion of the liquid flow path and a second face defining a portion of the communication chamber, and the liquid flow path and the communication chamber communicate with each other via the opening portion in a state that the elastic member opens the opening portion.

20. A liquid ejecting head comprising:

a nozzle configured to eject a liquid;

a liquid flow path communicating with the nozzle;

a communication chamber including a communication port configured to communicate with atmospheric air;

a partitioning wall portion provided between the liquid flow path and the communication chamber, the partitioning wall portion including an opening portion that communicates the liquid flow path and the communication chamber to each other; and an elastic member closing the opening portion, wherein an inner circumferential surface of the opening portion includes an inclined surface such that an inner diameter at a first position with respect to a direction of a central axis of the opening portion is smaller than an inner diameter at a second position with respect to the direction of the central axis of the opening portion, the second position being closer to the communication chamber than is the first position.

* * * * *